US010648113B2

(12) United States Patent
Zattin et al.

(10) Patent No.: US 10,648,113 B2
(45) Date of Patent: May 12, 2020

(54) METHOD FOR WASHING LAUNDRY IN A LAUNDRY WASHING MACHINE AND LAUNDRY WASHING MACHINE

(71) Applicant: Electrolux Home Products Corporation N.V., Brussels (BE)

(72) Inventors: Andrea Zattin, Solesino (IT); Elisa Stabon, Gorizia (IT); Maurizio Ugel, Fiume Veneto (IT); Monica Celotto, Motta di Livenza (IT); Nicola Reid, Budoia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 315 days.

(21) Appl. No.: 15/609,735

(22) Filed: May 31, 2017

(65) Prior Publication Data

US 2017/0260674 A1 Sep. 14, 2017

Related U.S. Application Data

(62) Division of application No. 14/130,182, filed as application No. PCT/EP2012/062775 on Jun. 29, 2012, now abandoned.

(30) Foreign Application Priority Data

Jun. 30, 2011 (EP) ..... 11172242

(51) Int. Cl.

| | |
|---|---|
| ***D06F 39/08*** | (2006.01) |
| ***D06F 39/04*** | (2006.01) |
| ***D06F 35/00*** | (2006.01) |
| ***D06F 25/00*** | (2006.01) |

(52) U.S. Cl.

CPC ..... *D06F 25/00* (2013.01); *D06F 35/006* (2013.01); *D06F 39/04* (2013.01); *D06F 39/083* (2013.01);

(Continued)

(58) Field of Classification Search

CPC ..... D06F 39/02; D06F 39/022; D06F 39/028; D06F 25/00; D06F 35/006; D06F 39/04; D06F 39/083

See application file for complete search history.

(56) References Cited

U.S. PATENT DOCUMENTS

| | | | |
|---|---|---|---|
| 4,489,455 | A | 12/1984 | Spendel |
| 8,490,439 | B2 | 7/2013 | Hill et al. |

(Continued)

FOREIGN PATENT DOCUMENTS

| | | | |
|---|---|---|---|
| CN | 101173451 | A | 5/2008 |
| CN | 101696544 | A | 4/2010 |

(Continued)

OTHER PUBLICATIONS

English translation of an Office Action dated Dec. 14, 2015 in related Chinese Application No. 201280032692.7.

(Continued)

*Primary Examiner* — Joseph L. Perrin
*Assistant Examiner* — Irina Graf
(74) *Attorney, Agent, or Firm* — RatnerPrestia

(57) ABSTRACT

A method for washing laundry in a washing machine utilizes a washing tub external to a rotatable washing drum. The method includes providing a quantity of detergent, providing a first quantity of water to form with the detergent a quantity of washing solution, introducing the washing solution into the tub, recirculating the washing solution inside the tub by recirculation until the washing solution is absorbed by the loaded laundry inside the drum and the level of the washing solution is below the drum, activating a heater for heating the wetted loaded laundry inside the drum deactivating the heater and maintaining the heated wetted loaded laundry inside the drum for a predetermined dry maintenance time, supplying a second quantity of water in (Continued)

the tub, rotating the drum, and rinsing the loaded laundry by drum rotations and by liquid drainage from the tub.

14 Claims, 12 Drawing Sheets

(52) U.S. Cl.
CPC ..... *D06F 2204/02* (2013.01); *D06F 2204/04* (2013.01); *D06F 2204/082* (2013.01); *D06F 2204/086* (2013.01)

(56) References Cited

U.S. PATENT DOCUMENTS

2007/0283507 A1 12/2007 Wong et al.
2007/0283508 A1 12/2007 Wong et al.
2012/0304394 A1* 12/2012 Dawudian ..... D06F 35/00 8/137

FOREIGN PATENT DOCUMENTS

DE 102007028212 A1 12/2008
EP 1867773 A1 12/2007

OTHER PUBLICATIONS

International Search Report dated Nov. 30, 2012 in corresponding International Application No. PCT/EP2012/062775.
Extended European Search Report dated Dec. 23, 2011 in corresponding European Application No. 11172242.7.

* cited by examiner

METHOD FOR WASHING LAUNDRY IN A LAUNDRY WASHING MACHINE AND LAUNDRY WASHING MACHINE

The present invention concerns the field of laundry washing techniques.

In particular, the present invention refers to a method for washing laundry in a laundry washing machine.

BACKGROUND ART

Nowadays the use of laundry washing machines, both "simple" laundry washing machines (i.e. laundry washing machines which can only wash and rinse laundry) and washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub inside which there is a rotatable perforated drum in which the laundry is placed.

A loading/unloading door ensures access to the tub and the drum.

Laundry washing machines typically comprise a detergent supply unit and a water inlet circuit for the introduction of water and washing/rinsing products (i.e. detergent, softener, etc.) into the tub.

Known laundry washing machines are also provided with water draining devices that may operate both during the initial phases of the washing cycle and at the end of the same to drain the dirty water.

In particular, a known complete washing cycle typically includes a first laundry wetting phase with addition of the washing detergent, a second washing phase during which the tub is rotated and the water contained therein is heated to predetermined temperature values based on the washing programme selected by the user, and a final rinsing and spinning phase.

According to the known technique, the initial wetting phase includes the step of mixing a predetermined amount of detergent with water to form a liquor which is introduced in the tub for wetting the laundry.

A wetting method belonging to the known technique is disclosed in document U.S. Pat. No. 4,489,455A. In this document the wetting phase includes first the preparation of a wash liquor in a wash liquor reservoir. The liquor is prepared by introducing in the wash liquor reservoir a predetermined amount of detergent composition, which may be in granular, paste, gel or in liquid form, and a predetermined amount of water. A proper mixing of the detergent and of the water takes place in the reservoir by the recirculation of the liquid from the bottom of the reservoir back into the reservoir through connecting lines.

Recirculation of the liquid is carried out until the detergent composition is substantially dissolved or dispersed in the water.

The liquor is then distributed by means of a high pressure spray nozzle as the drum rotates and the laundry is distributed about the periphery of the movable drum.

To further enhance distribution of the detergent, wash liquor application may be carried out in several stages, with the drum being momentarily stopped and restarted between each stage to allow the articles to completely redistribute themselves prior to each stage of wash liquor application. Also, multiple spray nozzles may be employed.

However, the method of wetting the laundry above described belonging to the known art poses some drawbacks.

A first drawback posed by this known technique is constituted by the fact that part of the liquor which is sprayed on the laundry falls down in the hollow space between the drum and the tub so that part of the detergent does not reach the laundry. Therefore a perfect and homogeneous distribution of the detergent on the laundry is not guaranteed.

A further drawback of the known technique is presented by the fact that the optimum laundry/detergent ratio is not obtained.

Another drawback is presented by the fact that the distribution phase of the liquor requires rotations of the drum with the laundry placed therein which leads to a high electric power consumption.

SUMMARY OF SELECTED INVENTIVE ASPECTS

An object of the present invention is therefore to overcome the drawbacks posed by the known technique.

It is a first object of the invention to implement a washing method that makes it possible to optimise the usage of the detergent and to reduce the quantity of detergent used compared to the known technique.

It is a further object of the invention to implement a washing method that makes it possible to obtain more efficient wetting of the laundry compared to the known technique.

It is a further object of the invention to implement a washing method that makes it possible to reduce the water consumption compared to the known technique.

It is a further object of the invention to implement a washing method that makes it possible to reduce the power consumption compared to the known technique.

The present invention therefore relates, in a first aspect thereof, to a method for washing laundry in a laundry washing machine comprising a washing tub external to a rotatable washing drum wherein the laundry to be washed is loaded, the method comprising the steps of:

- providing a quantity of detergent;
- providing a first quantity of water to form with said quantity of detergent a quantity of washing solution;
- introducing said washing solution into said washing tub;
- recirculating said washing solution inside said washing tub by means of recirculation means until said washing solution is absorbed by said loaded laundry inside said washing drum and the level of said washing solution is below said washing drum;
- activating heating means for heating said wetted loaded laundry inside said washing drum;
- deactivating said heating means and maintain said heated wetted loaded laundry inside said washing drum for a predetermined dry maintenance time;
- supplying a second quantity of water in said washing tub;
- rotating said washing drum;
- rinsing said loaded laundry by means of drum rotations and by means of liquid drainage from said washing tub.

In a preferred embodiment the method comprises a rotation phase of the washing drum during the step of recirculating the washing solution inside the washing tub.

Preferably the method comprises a rotation phase of the washing drum during the step of heating the wetted loaded laundry inside the washing drum.

Advantageously the method comprises a rotation phase of the washing drum during the step of maintaining the heated wetted loaded laundry inside the washing drum for a predetermined dry maintenance time.

Opportunely, the method comprises a recirculating phase of liquid inside the washing tub after the phase of supplying a second quantity of water in the washing tub.

In a preferred embodiment the method comprises a further phase of providing a pre-wetting quantity of water inside the washing tub in order to wet the loaded laundry before the phase of introducing the washing solution into the washing tub.

Advantageously the method comprises a recirculating phase of water inside the washing tub after the phase of providing a pre-wetting quantity of water.

Preferably the heating phase comprises heating the loaded laundry with hot air.

In an alternative embodiment the heating phase comprises heating the loaded laundry with steam.

Advantageously the first quantity of water is based on the quantity and/or on the type of the loaded laundry.

Preferably the ratio between the first quantity of water and the dry weight of the loaded laundry is between 1 and 3 litres/kg.

Preferably the ratio is between 1.3 and 2.7 litres/kg.

Preferably the ratio is between 1.5 and 2.5 litres/kg.

Preferably the ratio is between 1.7 and 2.3 litres/kg.

Preferably the ratio is between 1.8 and 2.2 litres/kg.

Preferably the ratio is between 1.5 and 2.0 litres/kg.

More preferably the ratio between the first quantity of water and the dry weight of the loaded laundry is between 1.5 and 1.8 litres/kg.

More preferably the ratio is between 1.5 and 1.8 litres/kg, when the laundry 30 is substantially constituted by the "cotton base load" as defined in the international standard IEC 60456.

Advantageously the second quantity of water is based on the quantity and/or on the type of the loaded laundry.

Preferably the ratio between the second quantity of water and the dry weight of the loaded laundry is between 0.5 and 1.1 litres/kg.

Preferably the ratio is between the second quantity of water and the dry weight of the loaded laundry is between 0.7 and 0.9 litres/kg.

More preferably the ratio between the second quantity of water and the dry weight of the loaded laundry is between 0.7 and 0.9 litres/kg, when the laundry 30 is substantially constituted by the "cotton base load" as defined in the international standard IEC 60456. Advantageously the pre-wetting quantity of water and the first quantity of water are stated based on the quantity and/or on the type of the loaded laundry.

Preferably the ratio between the sum of the pre-wetting quantity of water and the first quantity of water and the dry weight of the loaded laundry is between 1 and 3 litres/kg.

Preferably the ratio is between 1.3 and 2.7 litres/kg.

Preferably the ratio is between 1.5 and 2.5 litres/kg.

Preferably the ratio is between 1.7 and 2.3 litres/kg.

Preferably the ratio is between 1.8 and 2.2 litres/kg.

Preferably the ratio is between 1.5 and 2.0 litres/kg.

More preferably the ratio between the sum of the pre-wetting quantity of water and the first quantity of water and the dry weight of the loaded laundry is between 1.5 and 1.8 litres/kg.

More preferably the ratio is between 1.5 and 1.8 litres/kg, when the laundry 30 is substantially constituted by the "cotton base load" as defined in the international standard IEC 60456.

Preferably the method comprises a mixing phase in which the quantity of detergent and the first quantity of water are mixed to form said washing solution.

Advantageously the mixing phase takes place before the phase of introducing the washing solution into the washing tub.

In a preferred embodiment the mixing phase takes place in a drawer of the laundry washing machine suitable to contain washing and/or rinsing products.

In a further embodiment the mixing phase takes place in a container suitable to receive water and to receive detergent from a drawer of the laundry washing machine suitable to contain washing and/or rinsing products.

In a further preferred embodiment the mixing phase takes place into the washing tub after the phase of introducing the washing solution into the washing tub.

Advantageously the mixing phase is carried out by means of a recirculating device.

Opportunely, the recirculating device comprises a recirculating circuit provided with a recirculating pump.

In an alternative embodiment the recirculating device comprises a mixer device.

In a second aspect thereof, the present invention concerns a laundry washing machine suited to implement the method of the invention described above.

BRIEF DESCRIPTION OF THE DRAWINGS

Further characteristics and advantages of the present invention will be highlighted in greater detail in the following detailed description of some of its preferred embodiments, provided with reference to the enclosed drawings. In said drawings.

DETAILED DESCRIPTION OF EXAMPLE EMBODIMENTS

Figure 1:
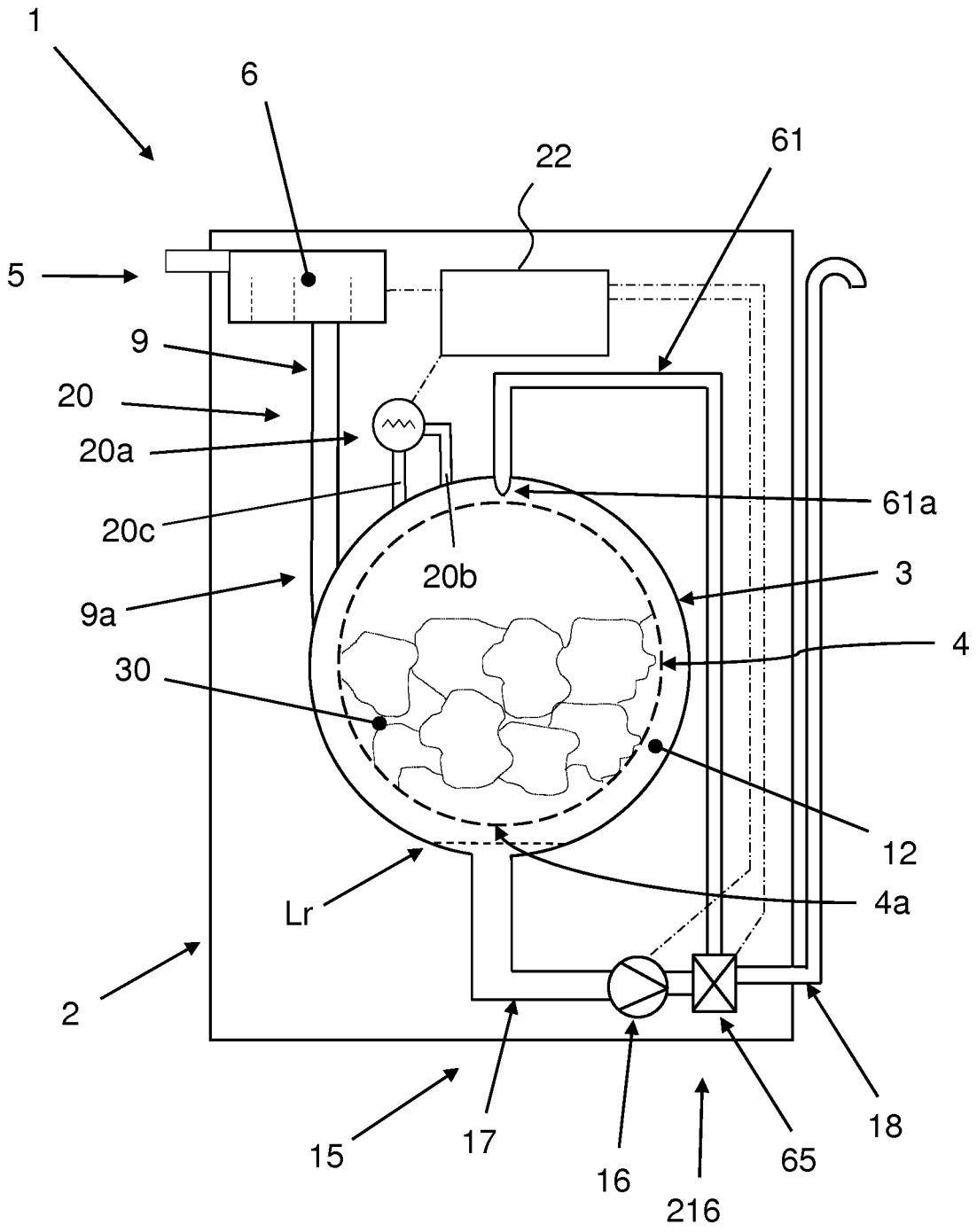
FIG. 1 shows a front view of a laundry washing machine implementing the method according to a first embodiment of the invention.
Figure 2:
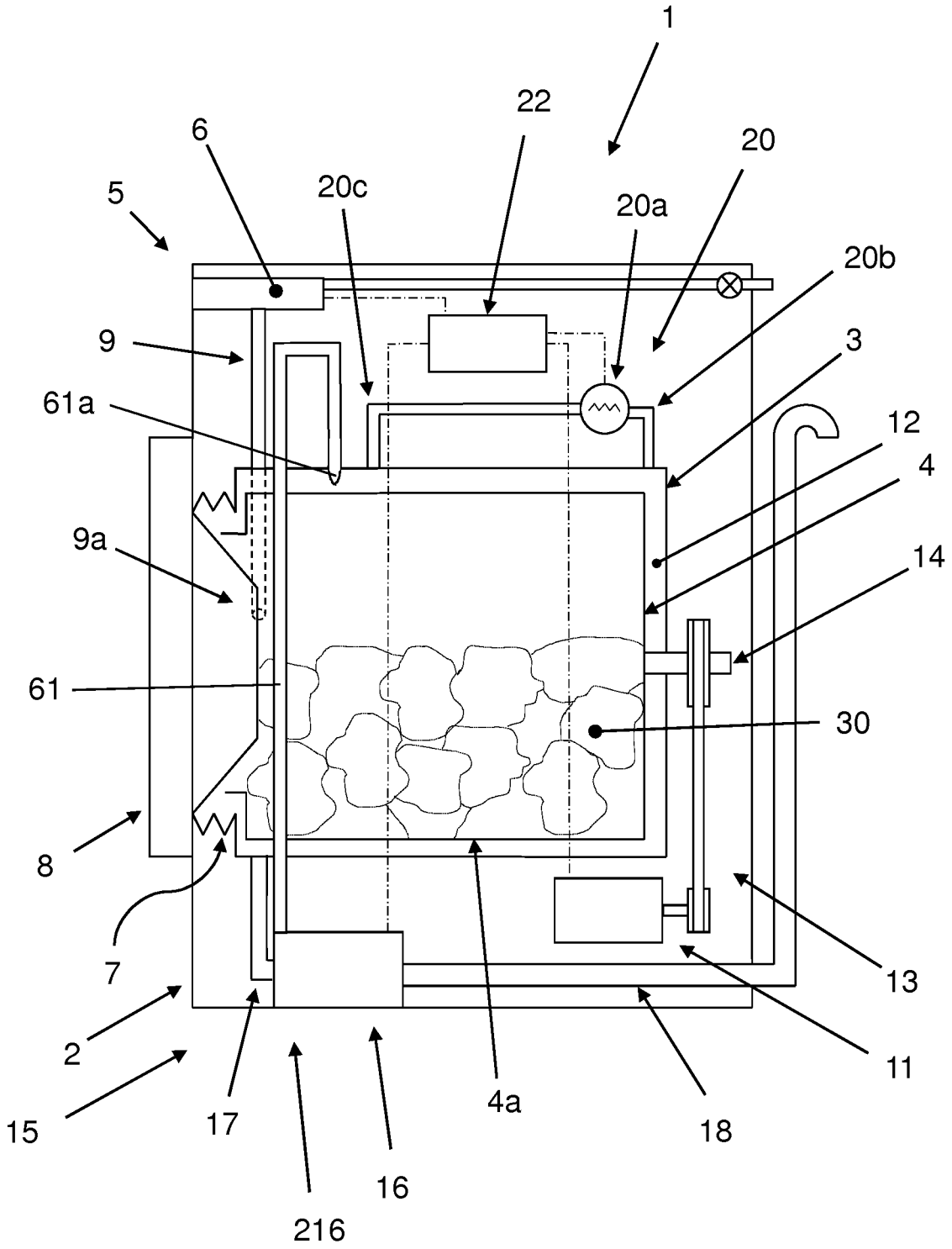
FIG. 2 shows a side view of the laundry washing machine shown in FIG. 1.

With reference to FIG. 1 and FIG. 2, a laundry washing machine 1 is illustrated, in which a method according to a first embodiment of the invention is advantageously implemented.

The laundry washing machine 1 comprises an external casing or casing 2, in which a washing tub 3 is provided that contains a rotatable perforated drum 4, where the laundry 30 to be washed can be loaded.

The tub 3 and the drum 4 both have preferably a substantially cylindrical shape.

A hollow space 12 is defined between the tub 3 and the drum 4.

The casing 2 is provided with a loading/unloading door 8 which allows access to the washing tub 3 and the drum 4.

The tub 3 is preferably suspended in a floating manner inside the casing 2, advantageously by means of a number of coil springs and shock-absorbers that are not illustrated herein.

The tub 3 is preferably connected to the casing 2 by means of an elastic bellows 7, or gasket.

The drum 4 is advantageously rotated by an electric motor 11 which preferably transmits the rotating motion to the shaft 14 of the drum 4, advantageously by means of a belt/pulley system 13. In a different embodiment of the invention, the motor 11 can be directly associated with the shaft 14 of the drum 4.

A water inlet circuit 5 is arranged in the upper part of the laundry washing machine 1 and is suited to supply water and washing/rinsing products (i.e. detergent, softener, etc.) into the tub 3.

The water inlet circuit 5 advantageously comprises a removable drawer 6 provided with various compartments suited to be filled with washing and/or rinsing products.

The water is supplied into the tub 3 by making it flow through the drawer 6 and a supply pipe 9. The supply pipe output 9*a* of the supply pipe 9 ends in correspondence of the tub 3. Preferably the supply pipe output 9*a* ends in correspondence of a lateral side of the tub 3.

In the embodiment herein described, the water is supplied into the tub 3 by making it flow through the drawer 6.

In a preferred embodiment of the invention the inlet circuit 5 comprises a bypass duct, not illustrated, that bypasses the compartments of the drawer 6, so as to allow supplying exclusively water (i.e. without detergent) into the tub 3.

In an alternative embodiment of the invention, not shown, the laundry washing machine 1 comprises a separate water supply pipe, separated from the inlet circuit 5, adapted to supply water directly into the tub 3.

The water inlet circuit 5 also preferably comprises a water flow sensor, for example a flow meter, which makes it possible to calculate the quantity of water or of the washing and/or rinsing products supplied into the tub 3.

Laundry washing machine 1 advantageously comprises a water outlet circuit 15.

The water outlet circuit 15 advantageously comprises a drain pump 16, a first pipe 17 connecting the tub 3 to the drain pump 16 and an outlet pipe 18 ending outside the casing 2. The water outlet circuit 15 is suited to drain the liquid, i.e. dirty water or water mixed with washing and/or rinsing products, from the tub 3 to the outside.

The water outlet circuit 15 also preferably comprises a water flow sensor, for example a flow meter, which makes it possible to calculate the quantity of liquid drained from the tub 3.

The water outlet circuit 15 is advantageously provided with a recirculation circuit 216 adapted to drain liquid from a bottom region of the tub 3 and to re-admit such a liquid into a higher region of the tub 3.

The recirculation circuit 216 comprises the drain pump 16 and a recirculation pipe 61. The recirculation pipe 61 advantageously ends with a terminal nozzle 61*a* in an upper region of the tub 3. In further embodiments the recirculation pipe 61 preferably ends with a plurality of terminal nozzles and preferably at least one of the nozzles ends in the proximity of the front door 8 and partially arranged inside the bellows 7.

A two-way valve 65 is preferably interposed between the drain pump 16, the outlet pipe 18 and the recirculation pipe 61.

The two-way valve 65 is preferably properly controlled in order to allow selective drainage towards the outside through the outlet duct 18 or towards the upper region of the tub 3 through the recirculation pipe 61.

In a further embodiment, not illustrated, the recirculation circuit may comprise a dedicated recirculation pipe connecting a bottom region of the tub with and higher region of the latter, and provided with a dedicated recirculation pump; in this case the recirculation circuit is advantageously completely separated from the water outlet circuit.

In general, the recirculation circuit is properly realized for transferring a portion of a liquid from a region of the tub to another region of the tub.

The water outlet circuit 15 advantageously comprises a filtering device, not shown in the figures, placed between the bottom of the tub 3 and the drain pump 16 and adapted to retain all the undesirable bodies (for example buttons that have come off the laundry, coins erroneously introduced into the laundry washing machine, etc.) that have passed through the holes located on the surface of the drum 4, or fallen onto the bottom of the tub 3 while passing in the hollow space 12 between the drum 4 and the tub 3, which could damage or obstruct the drain pump 16.

This filtering device can preferably be removed, and then for example cleaned, through a gate placed advantageously on the front or back wall of the casing 2 of the laundry washing machine 1, not shown herein; in a further embodiment, not illustrated, the filtering device can be accessed for example by the internal of the drum 4, for example by a suitable opening obtained therein and selectively closed by a suitable cover, or by a removable lifter of the drum 4.

The laundry washing machine 1 advantageously comprises a heating device 20. In the preferred embodiment herein illustrated the heating device 20 is a closed loop recirculation system comprising a heating unit 20*a* provided with an inlet duct 20*b* and an output duct 20*c* both communicating with the tub 3. The heating unit 20*a* preferably comprises an air circulating blower and an heater element, as for example a resistor or electric heaters. The air circulating blower conveys the air withdrawn from the tub 3 through the inlet duct 20*b* to the heater element. The air heated by the heater element is then introduced again in the tub 3 through the output duct 20*c*. The heating device 20 when activated, therefore, recirculates and heats the air, or the humid air, inside the tub 3.

Advantageously laundry washing machine 1 comprises a temperature sensor, not illustrated in the figures, for sensing the temperature inside the tub 3.

The temperature sensor is advantageously used when the closed loop system defined by the heating device 20 is activated so that the temperature inside the tub 3 is continuously monitored and maintained at a predetermined level.

Laundry washing machine 1 advantageously comprises a control unit 22 connected to the various parts of the laundry washing machine 1 in order to ensure its operation. The control unit 22 preferably is connected to the water inlet circuit 5, the water outlet circuit 15, the heating device 20 and the electric motor 11 and receives information from the various sensors provided on the laundry washing machine 1, like the flow meter of the water inlet circuit 5 or of the outlet circuit 15, the temperature sensor, etc.

Laundry washing machine 1 advantageously comprises an interface unit, not visible in the enclosed figures, connected to control unit 22, accessible to the user and by means of which the user may select and set the washing parameters, like for example a desired washing program. Usually, other parameters can optionally be input by the user, for example the washing temperature, the spinning speed, the load in terms of weight of the laundry to be washed, etc.

Based on the parameters acquired by said interface, the control unit 22 sets and controls the various parts of the laundry washing machine 1 in order to carry out the desired washing program.

A first embodiment of the washing method that is the subject of the invention is described here below with reference to FIGS 1 to 3.

Figure 3:
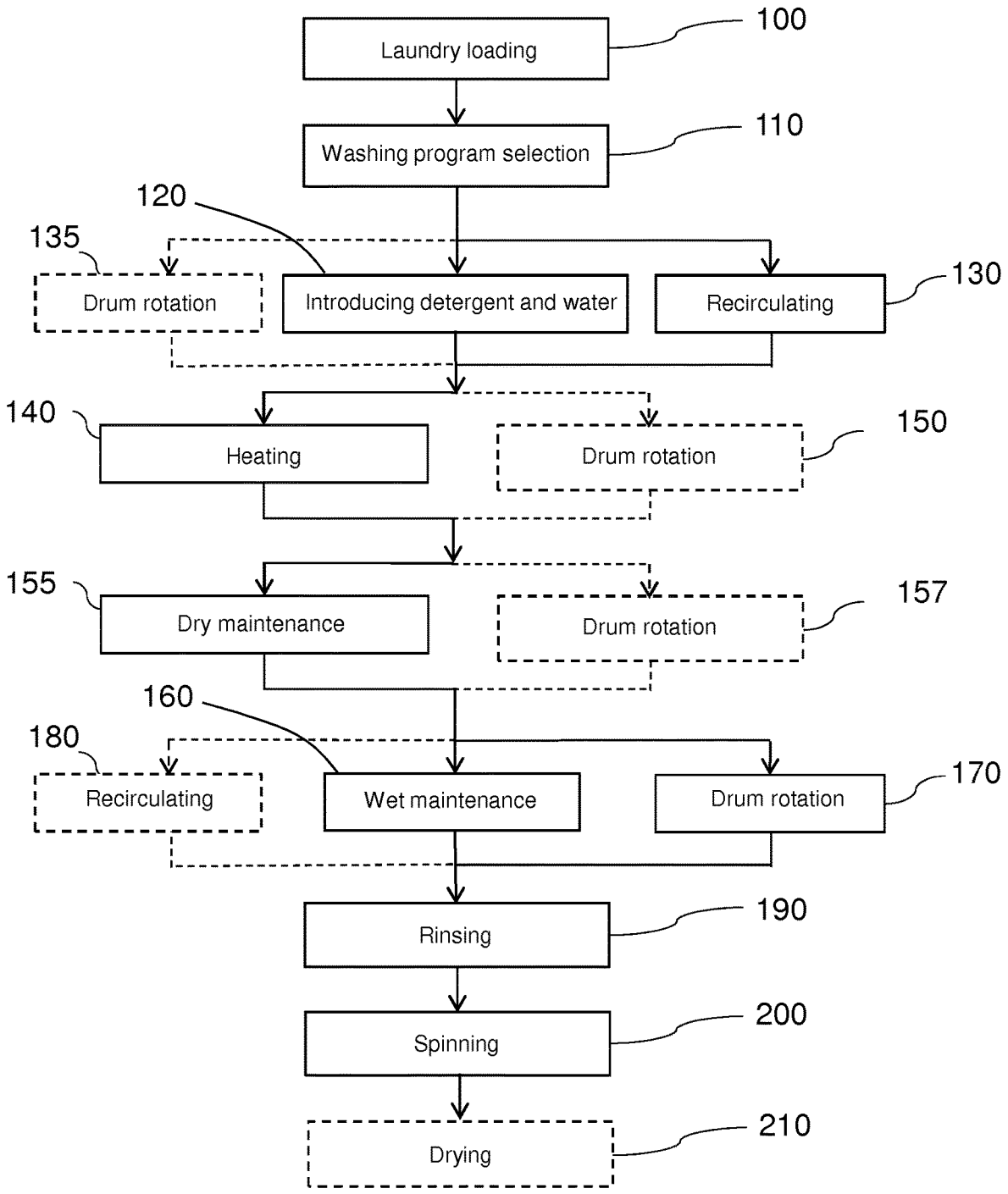
FIG. 3 is a simplified flow chart of the basic operations of a method for washing laundry in the washing machine of FIG. 1 according to a first embodiment of the invention.

The laundry 30 to be washed is first placed inside the drum 4 (step 100 of FIG. 3). By operating on the interface unit the user selects the desired washing program (step 110) depending for example on the type and on the dirty-level of the products to wash. Furthermore, as said before, in a preferred embodiment it is possible for the user to input some parameters directly by the interface unit, for example the value of the washing temperature, the rotating speed of the drum 4 in the spinning phase, the duration of washing cycle, etc.

Once the user has selected the desired washing program, the control unit 22 sets the laundry washing machine 1 so that it starts the washing cycle.

In a further embodiment, the selection of the desired washing program (step 110) may be performed before placing the laundry 30 into the drum 4 (step 100).

In a successive phase (step 120) a quantity Qd of detergent D together with a first quantity $Q1_w$ of water W is introduced into the tub 3. The quantity Qd of detergent D and the first quantity $Q1_w$ of water W form a washing solution S intended to wet the laundry 30.

Advantageously the quantity Qs of the washing solution S, namely the sum of the quantity Qd of detergent D and the first quantity $Q1_w$ of water W, is a quantity Qs that does not exceed the absorption capacity of the laundry 30, as better explained below in the description.

It has to be noted that the quantity Qs of the washing solution S in terms of volume, or weight, corresponds substantially to the volume, or weigh, of the first quantity $Q1_w$ of water W. In fact, the quantity Qd of detergent D used for the washing solution S represents a minimal part of the washing solution S itself. For example a typical volume ratio between the detergent D and the washing solution S is less than 2%.

It follows that throughout the description when we state that the quantity Qs of the washing solution S does not exceed the absorption capacity of the laundry 30 is substantially equivalent to state that the first quantity $Q1_w$ of water W does not exceed the absorption capacity of the laundry 30.

The introduction of the quantity Qd of detergent D takes place preferably through the water inlet circuit 5; the quantity Qd of detergent D, being it powder or liquid, is preferably brought out of the apposite compartment of the drawer 6 by the first quantity $Q1_w$ of water W that passes through the proper compartment of the drawer 6.

The quantity Qd of detergent D and the first quantity $Q1_w$ of water W, i.e. the washing solution S, then flow through the supply pipe 9 up to the supply pipe output 9*a*.

Preferably, all the washing solution S introduced inside the tub 3 by means of the supply pipe 9 advantageously falls down on the bottom of the tub 3. That is guaranteed by the lateral position of supply pipe output 9*a* with respect to the tub 3.

Preferably the washing solution reaches the bottom of the tub without entering the drum and without affecting the clothes contained inside the drum Nevertheless a minimum quantity of the washing solution S may also reach the laundry 30 inside the perforated drum 4.

According to the invention, during the introduction of the washing solution S (step 120) the recirculation circuit 216 is activated (step 130).

The washing solution S which lies on the bottom of the tub 3 is drained towards the upper part of the tub 3 by means of the drain pump 16. The drain pump 16 takes the washing solution S from the bottom of the tub 3 and conveys it towards the upper part of the tub 3 through the recirculation pipe 61 via the valve 65 opportunely driven by the control unit 22.

The washing solution S therefore flows through the recirculation pipe 61 up to the terminal nozzle 61*a* and from there advantageously reaches the laundry 30 from above.

By means of this recirculation process, uniform and complete wetting of the laundry 30 with the washing solution S can be accomplished.

Preferably the recirculation process takes place for a pre-established period of time deemed sufficient to withdraw all the washing solution S from the bottom of the tub 3 and sufficient for its complete absorption by the laundry 30.

The complete absorption of the laundry 30 is guaranteed by the fact that, as said before, the quantity Qs of the washing solution S is preferably properly chosen so that it does not exceed the absorption capacity of the laundry 30.

At the end of the recirculation process the hollow space 12 between the tub 3 and the drum 4, therefore, is advantageously substantially empty and free from any liquid.

More generally, at the end of the recirculation process the washing solution S is substantially totally absorbed by the laundry 30. It is clear that a minimum quantity of residual washing solution S may remain on the bottom of the tub 3. In any case, the level Lr of the residual washing solution S on the bottom of the tub 3 is substantially below the bottom part 4*a* of the drum 4, as shown in FIG. 1.

Preferably, during the introduction of the washing solution S (step 120) or/and during the recirculation phase (step 130) the drum 4 is set rotated (step 135), so as to enhance the absorption of the washing solution S by the laundry 30.

Rotations of the drum 4 takes place with a preferred rhythm, for example in clockwise and/or anticlockwise direction, at a low speed (e.g. at [10-80] rpm), and advantageously with stop interval time between successive rotations.

In a further embodiment, the recirculation phase (step 130) may be performed after the introduction of the washing solution S into the tub 3 (step 120).

The first quantity $Q1_w$ of water W is preferably defined before its introduction in the tub 3 in such a way that the washing solution S completely wet the loaded laundry 30, as said before.

The first quantity $Q1_w$ of water W which is introduced in the tub 3 may be measured, during its introduction, for example by a flow meter, not illustrated, provided in the water inlet circuit 5, or by processing other parameters, for example the pressure of the delivered water and the duration of the water delivery; in this way it is possible to introduce into the tub 3 exactly the prefixed quantity $Q1_w$.

The first quantity $Q1_w$ of water W of the washing solution S necessary to completely wet the laundry 30 depends mainly on the quantity (i.e. dry weight $D_w$) of loaded laundry 30 and on the type of laundry 30. In fact, for example, cotton absorbs much more water than synthetic fibres, and therefore a certain quantity of laundry made of cotton requires, in order to be completely wetted, much more water than a same quantity of laundry made of synthetic fibres. The control unit 22 may be advantageously configured in such a way to determine (e.g. to calculate by applying a prefixed algorithm or to select among a series of memorized values) which is the first quantity $Q1_w$ of water W of the washing solution S necessary to completely wet the laundry 30 on the basis of the dry weight $D_w$ of the laundry 30 and preferably also of the type of the loaded laundry.

The ratio between the first quantity $Q1_w$ of water W and the dry weight $D_w$ of the laundry 30 is preferably between 1 and 3 litres/kg.

Preferably this ratio $Q1_w/D_w$ is between 1.3 and 2.7 litres/kg.

Preferably this ratio $Q1_w/D_w$ is between 1.5 and 2.5 litres/kg.

Preferably this ratio $Q1_w/D_w$ is between 1.7 and 2.3 litres/kg.

Preferably this ratio $Q1_w/D_w$ is between 1.8 and 2.2 litres/kg.

Preferably this ratio $Q1_w/D_w$ is between 1.5 and 2.0 litres/kg.

Preferably this ratio $Q1_w/D_w$ is between 1.5 and 1.8 litres/kg.

The ratio between the first quantity $Q1_w$ of water W and the dry weight $D_w$ of the laundry 30 is more preferably between 1.5 and 1.8 litres/kg when the laundry 30 is substantially constituted by the "cotton base load" as defined in the international standard IEC 60456.

The control unit 22 may also advantageously set the proper quantity of first quantity Q1 of water W which form the quantity Qs of washing solution S so as to obtain a suitable water-detergent ratio value. This optimal value allows obtaining the better washing performances. The provision of this optimal water-detergent ratio value allows the use of a reduced quantity of detergent D with respect to the known technique.

The dry weight $D_w$ of the laundry 30 can be obtained by the control unit 22 in different ways.

The dry weight $D_w$ can be, for example, one of the parameters introduced by the user when setting the washing program.

In further embodiment, the dry weight $D_w$ of the laundry 30 can be advantageously obtained by means of suitable weight sensors provided in the laundry washing machine 1, for example sensors that can be associated with the shock-absorbers of the tub 3.

Again, the control unit 22 may advantageously obtain the dry weight $D_w$ of the laundry 30 by measuring the power absorbed by the motor 11 for the rotation of the drum 4 with the laundry 30 inserted therein. In this case, it is possible to set a brief rotation cycle of the drum 4 before the introduction of water, therefore with dry laundry 30, in order to measure the moment of inertia of the laundry 30 based on the power absorbed by the electric motor 11 and thus obtain the dry weight $D_w$ of the laundry 30 itself by means of simple calculations.

Clearly any other method may be used to determine the quantity of the loaded laundry 30. The type of fabric to be washed may be advantageously communicated to the control unit 22 directly by the user, for example by the interface unit (not illustrated), when setting the washing program.

In another embodiment the control unit 22 may be configured in such a way to sense or detect the type of loaded laundry by suitable sensing/detecting means, for example optical detecting means.

Once the laundry 30 is completely wetted, a heating phase is performed (step 140).

During this phase (step 140) the recirculation circuit 216 is advantageously deactivated, being the hollow space 12 between the tub 3 and the drum 4 substantially empty.

During the heating phase (step 140) the temperature Tr of the wetted laundry 30 is increased.

The heating of the laundry 30 is advantageously carried out by the activation of the heating device 20.

The air circulating blower of the heating unit 20*a* conveys the air withdrawn from the tub 3 through the inlet duct 20*b* to the heater element. The air heated by the heater element is then introduced again in the tub 3 through the output duct 20*c*. The heating device 20 in this way recirculates and heats the humid air inside the tub 3.

The activation of the heating device 20, therefore, raises the temperature of the laundry 30 to a heating temperature Tr.

The temperature Tr of the laundry 30 can be preferably estimated by the control unit 22. For example the temperature Tr may be estimated from the sensed air temperature T inside the tub 3 and by knowing the dry weight $D_w$ of the laundry 30.

Clearly any other technique or method may be used to determine or estimate the temperature Tr of the laundry 30.

In a first embodiment of the invention, the heating phase (step 140) takes place for a predetermined heating time $t_h$.

The predetermined heating time $t_h$ is advantageously set according to the type of loaded laundry 30 and/or the quantity of loaded laundry 30. For example for cotton laundry, the heating time $t_h$ may be between 1 and 30 minutes.

During the heating phase (step 140) the laundry temperature Tr is preferably kept at a substantially constant value, for example a constant value between 30° C. and 40° C., or in a temperature range between a minimum temperature Tmin and a maximum temperature Tmax.

The minimum temperature Tmin is preferably between 15° C. and 25° C., and the maximum temperature Tmax is preferably between 25° C. and to 50° C.

The predetermined temperature Tr is advantageously set according to the type of the loaded laundry 30 and/or the quantity of loaded laundry 30.

During the heating phase (step 140), one or more rotation cycles of the drum 4 are also preferably performed (step 150), so as to enhance uniform heating of the laundry 30.

In a preferred embodiment, a continuous rotation is performed, preferably at a low rotation speed, for example between around 10 and 80 rpm.

In further embodiments, successive rotation cycles are performed at prefixed time interval, preferably at low speed (for example around 10 and 80 rpm), with the same advantages mentioned above.

As said before, during the heating phase (step 140) the activation of the heating device 20 raises the temperature of the laundry 30 to the heating temperature Tr.

The heating phase of the present method is advantageously obtained with a reduced power consumption with respect the heating phase of the known technique. In fact the energy used during the heating phase of the present method is almost totally dissipated for heating the water absorbed by the laundry 30. On the other hand, the energy used for heating the liquid outside the laundry 30, which represents a waste energy, is very low. This is advantageously obtained thanks to the minimum quantity of residual washing solution S which remains on the bottom of the tub 3 before the heating phase.

Once the heating phase (step 140) has been completed, a dry maintenance phase is started (step 155).

In this phase the heating device 20*a* is deactivated and the laundry 30 is kept in this condition for a predetermined dry maintenance time td. This phase ensures that the washing solution S absorbed by the laundry 30 has time to react with the stained fabrics of the dirty laundry 30.

The predetermined dry maintenance time td is advantageously set according to the type of loaded laundry 30 and/or the quantity of loaded laundry 30 and is preferably between 10 min and 90 min. For example for cotton laundry, the dry maintenance time $t_d$ may be preferably between 30 min and 75 min.

During the dry maintenance phase (step 155), one or more rotation cycles of the drum 4 are also preferably performed (step 157).

In a preferred embodiment, a continuous rotation is performed, preferably at a low rotation speed, for example between around 10 and 80 rpm.

Once the dry maintenance phase (step 155) has been completed, a wet maintenance phase is started (step 160).

In this phase a second quantity $Q2_w$ of water W is introduced into the tub 3. During the wet maintenance phase (step 160), one or more rotation cycles of the drum 4 are also preferably performed (step 170).

The amount of liquid $L_q$ inside the tub 3 at this stage is the sum of the quantity Qs of the washing solution S and of the second quantity $Q2_w$ of water W. The laundry 30 is already completely wetted from the previous phases and therefore the liquid $L_q$ exceeds the absorption capacity of the laundry 30. Part of liquid $L_q$, therefore, falls down on the bottom of the tub 3.

For this reason in a further preferred embodiment, the recirculation circuit 216 is activated (step 180) so that the exceeding liquid on the bottom of the tub 3 can be pumped and recirculated in the drum 4 over the laundry 30.

The introduction of the second quantity $Q2_w$ of water W preferably takes place through the water inlet circuit 5 that will provide for feeding water into the tub 3.

It is to be noted that the Applicant has found that the best washing performances can be achieved when the wet maintenance phase (step 160) does not include any heating phase, i.e. the heating device is switched off during the wet maintenance phase (step 160). However in other possible embodiments of the present invention the wet maintenance phase (step 160) can comprise one or more heating phase Rotations of the drum 4, preferably in clockwise and/or anticlockwise direction, advantageously takes place at a pre-determined rotational speed, for example in a range between 10 rpm and 80 rpm.

The amount of the second quantity $Q2_w$ of water W introduced during the wet maintenance phase (step 160) is preferably set so that the ratio between the second quantity $Q2_w$ of water W and the dry weight $D_w$ of the laundry 30 is between 0.5 to 1.1 litres/kg.

More preferably this ratio $Q2_w/D_w$ is between 0.7 and 0.9 litres/kg.

The second quantity $Q2_w$ of water W introduced during the wet maintenance phase helps the removal of stains from the stained fabrics and/or the removal of the detergent D which has reacted with the stained fabrics of the dirty laundry 30. The stains are therefore removed from the fabrics and transferred in the water inside the tub together with the detergent D to form a dirty liquid solution.

Once the wet maintenance phase (step 160) has been completed, the laundry 30 is clean and a rinsing phase is performed (step 190).

It is to be noted that during the wet maintenance phase (step 160), the drain pump 16 and in general the drainage line is deactivated so that the second quantity $Q2_w$ of water W is kept inside the tub to react with the fabric and preferably is recirculated through the tub 3 by means of the recirculation circuit 216 as described above.

The predetermined wet maintenance time td is advantageously set according to the type of loaded laundry 30 and/or the quantity of loaded laundry 30 and is preferably between 10 min and 90 min. For example for cotton laundry, the wet maintenance time td may be preferably between 30 min and 75 min.

The rinsing phase (step 190) comprises the removal from the laundry 30 and from the tub 3 of the dirty liquid produced during the wet maintenance phase (step 160).

The liquid on the bottom of the tub 3 is removed from the tub 3; the removal operation preferably includes the drainage of the liquid from the tub 3 towards the outside of the washing machine 1 by means of the drain pump 16 that takes the liquid from the bottom of the tub 3 and conveys it towards the outside through the outlet duct 18. The drainage of the liquid from the tub 3 towards the outside of the washing machine 1 is advantageously performed contemporaneously with, or after the, rotations of the drum at higher speed, so as to extract the rinsing liquid from the laundry 30.

The rinsing phase (step 190) may preferably comprise several consecutive cycles of the type just described.

Hence the washing program continues with a spinning phase (step 200).

The spinning phase preferably comprises one or more high-speed rotation cycles of the drum 4 to remove from the laundry 30 as much water as possible. The expression "high-speed" is to be interpreted as a speed which allows removing a suitable quantity of water from the laundry 30 by the centrifugal force; suitable values of speed are for example from 400 rpm to 1600 rpm.

The water expelled outside the drum 4 falls down on the bottom of the tub 3 and is removed from the tub 3 (after or contemporaneously with the spinning phase) by means of the drain pump 16 that takes the water from the bottom of the tub 3 and conveys it towards the outside through the outlet duct 18.

Once the spinning phase (step 200) terminates, the washing program is completed.

At this point, the user may take the laundry 30 out.

In case the washing program is performed in a laundry washing-drying machine, after the spinning phase (step 200) the laundry 30 may be advantageously subjected to a drying phase inside the drum 4 (step 210).

Figure 4:
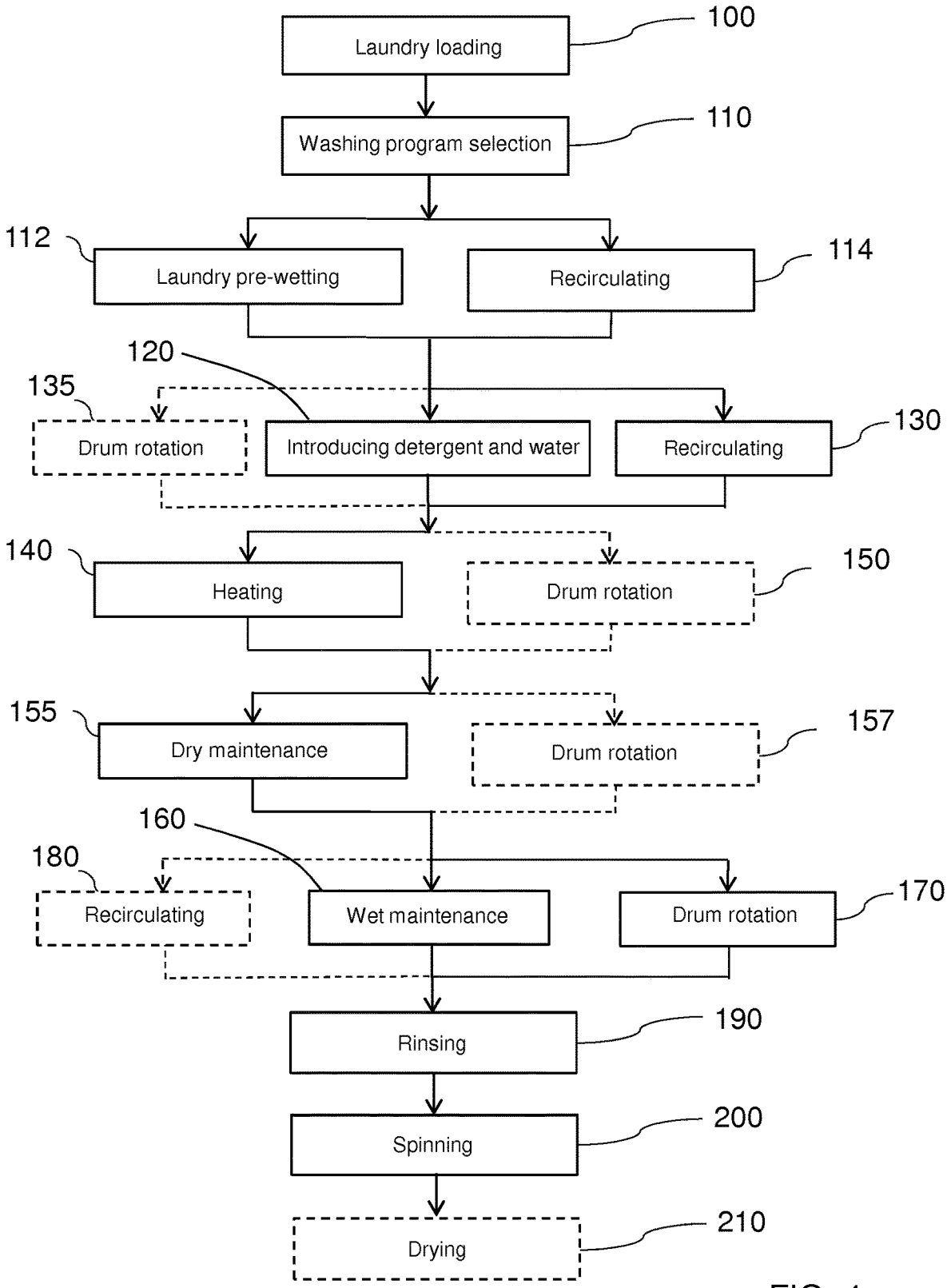
FIG. 4 shows a further embodiment in relation to FIG. 3.

FIG. 4 shows the flow chart of a further embodiment of the washing program of the invention performed in the laundry washing machine 1 of FIGS. 1 and 2.

This method differs from the method described with reference to FIGS. 1 and 2 for the fact that after the washing program selection (step 110) and before the phase of introducing into the tub 3 a quantity Qd of detergent D together with a first quantity $Q1_w$ of water W (step 120) a further phase of pre-wetting the laundry 30 with a pre-wetting quantity $Qp_w$ of water W is provided (step 112).

This pre-wetting phase (step 112) is advantageously performed on the base of the quantity (i.e. dry weight $D_w$) of loaded laundry 30 and on the type of laundry 30.

This phase (step 112) is preferably, but not necessarily, performed when the quantity (i.e. dry weight $D_w$) of loaded laundry 30 can be considered high.

In fact, if the dry weight $D_w$ of the loaded laundry 30 is high, namely a load greater than half the rated-load capacity of the laundry washing machine 1, a pre-wetting quantity $Qp_w$ of water W is preferably introduced in one step into the tub 3 (step 112). This quantity $Qp_w$ of water W is absorbed by the laundry 30 inside the drum 4 and enhance the wetting of the high quantity of laundry 30 before the introduction of the first quantity $Q1_w$ of water W in the following step.

The amount of this pre-wetting quantity $Qp_w$ of water W is calculated, or estimated, in such a way that after the successive phase (step 120) of introducing the washing solution S, the loaded laundry 30 is completely wetted and the level Lr of the residual washing solution S on the bottom of the tub 3 is substantially below the bottom part of the drum 4 or, even more preferably, the hollow space 12 between the tub 3 and the drum 4 is substantially empty and free from any liquid.

The amount of the pre-wetting quantity $Qp_w$ of water W is preferably set so that the ratio $(Qp_w+Q1_w)/D_w$ between the sum $Qp_w+Q1_w$ of the pre-wetting quantity $Qp_w$ of water W and the first quantity $Q1_w$ and the dry weight $D_w$ of the laundry 30 is between 1 and 3 litres/kg.

Preferably this ratio $(Qp_w+Q1_w)/D_w$ is between 1.3 and 2.7 litres/kg.

Preferably this ratio $(Qp_w+Q1_w)/D_w$ is between 1.5 and 2.5 litres/kg.

Preferably this ratio $(Qp_w+Q1_w)/D_w$ is between 1.7 and 2.3 litres/kg.

Preferably this ratio $(Qp_w+Q1_w)/D_w$ is between 1.8 and 2.2 litres/kg.

Preferably this ratio $(Qp_w+Q1_w)/D_w$ is between 1.5 and 2.0 litres/kg.

The amount of the pre-wetting quantity $Qp_w$ of water W is preferably set so that the ratio $(Qp_w+Q1_w)/D_w$ between the sum $Qp_w+Q1_w$ of the pre-wetting quantity $Qp_w$ of water W and the first quantity $Q1_w$ and the dry weight $D_w$ of the laundry 30 is between 1.5 and 1.8 litres/kg when the laundry 30 is substantially constituted by the "cotton base load" as defined in the international standard IEC 60456.

The complete absorption of the laundry 30 is guaranteed by the fact that the sum of the pre-wetting quantity $Qp_w$ of water W and the quantity Qs of the washing solution S is properly chosen so that it does not exceed the absorption capacity of the laundry 30.

This phase (step 112) is also preferably performed on the base of the type of the laundry 30, for example if the laundry is made of cotton it will require a higher quantity of water than a load of synthetic laundry.

During the introduction of the pre-wetting quantity $Qp_w$ of water W (step 112) the recirculation circuit 216 is advantageously activated (step 114).

The water W which lies on the bottom of the tub 3 is drained towards the upper part of the tub 3 by means of the drain pump 16 and reaches the laundry 30 from above.

By means of this recirculation process, uniform and complete wetting of the laundry 30 with the pre-wetting quantity $Qp_w$ of water W can be accomplished.

Preferably, the recirculation process takes place for a pre-established period of time deemed sufficient for the complete absorption of the pre-wetting quantity $Qp_w$ of water W by the laundry 30.

It has to be noted that the quantity $Qp_w$ of water W of the pre-wetting phase (step 112) here disclosed has to be considered the quantity of water that wet the laundry 30 before the phase of introducing into the tub 3 a quantity Qd of detergent D together with a first quantity $Q1_w$ of water W (step 120).

In the embodiment above described, the quantity $Qp_w$ of water W has been provided by introducing it in one step into the tub 3. Nevertheless, the pre-wetting phase (step 112) may be differently performed by comprising further steps of introducing water into the tub 3 and draining water from the tub 3. This steps may advantageously enhance and render more uniform the absorption of water by the laundry 30. Spinning steps may also advantageously be provided between said steps of introducing and draining water. In any case, the quantity of the remaining water which wets the laundry at the end of pre-wetting phase (step 112) represents the pre-wetting quantity $Qp_w$ of water before the successive introducing phase (step 120).

The quantity of this remaining water, i.e. the pre-wetting quantity $Qp_w$, may be easily calculated by the control unit through the measurement of the water introduced in the tub 3 and the water drained from the tub during the pre-wetting phase (step 112).

Figure 5:
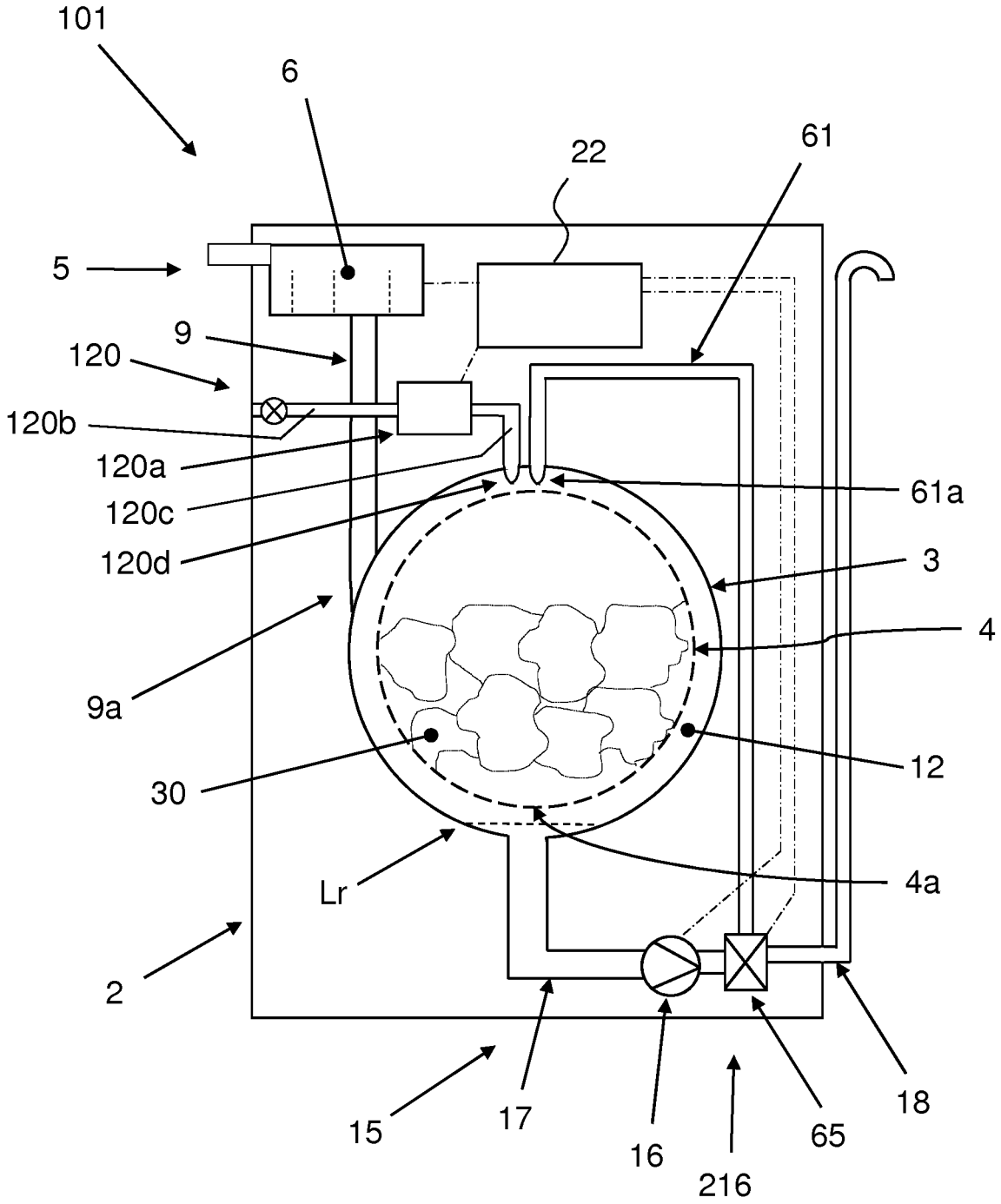
FIG. 5 shows a construction variant of the laundry washing machine of FIG. 1.

FIG. 5 shows a construction variant washing machine 101 implementing the method of the invention.

This washing machine 101 differs from the washing machine 1 shown in FIG. 1 for the fact that the heating device 120 comprises a steam supply device instead of a closed loop hot air recirculation system.

The steam supply device 120 is construed to supply a predetermined amount of steam into the tub 3 by evaporating water using high-temperature hot air. The steam supply device 120 comprises a heating unit **120*a* for generating high-temperature hot air to evaporate water coming from a water supply pipe 120*b*. It also comprises a steam supply pipe 120*c* through which steam generated from the water evaporation by the heating unit 120*a*** flows.

The steam supply pipe **120*c* advantageously ends with a terminal nozzle 120*d* in an upper region of the tub 3**.

The steam supply device 120 when activated, therefore, introduces hot and humid air inside the tub 3 and allows heating of the loaded laundry 30.

Figure 6:
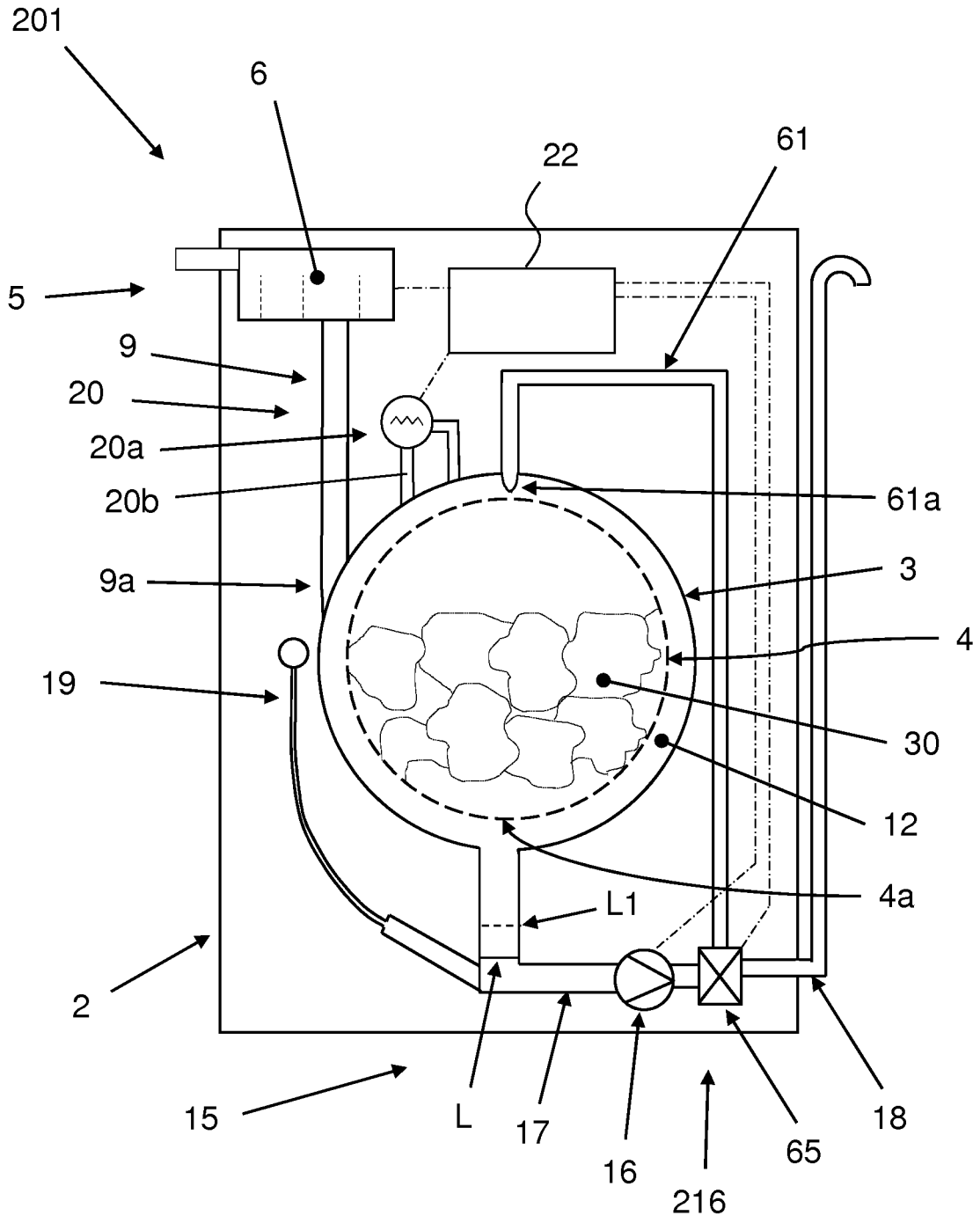
FIG. 6 shows another construction variant of the laundry washing machine of FIG. 1.

FIG. 6 shows a construction variant washing machine 201 implementing the method of the invention.

This washing machine 201 differs from the washing machine 1 shown in FIG. 1 for the fact that it comprises a device 19 suited to sense (or detect) the water level L inside the tub 3.

The device 19 preferably comprises a pressure sensor which senses the pressure in the tub 3, which value is related to the level of free water contained in the tub 3. In another embodiment, not illustrated, laundry washing machine 1 comprises (in addition to or as a replacement of the pressure sensor) a level sensor (for example mechanical, electromechanical, optical, etc.) adapted to sense (or detect) the water level inside the tub 3.

The provision of the device 19 simplifies the phase of introducing water W inside the tub 3 to wet completely the laundry 30.

With this device 19 the necessity of determining in advance the first quantity $Q1_w$ of water W to be introduced in the tub 3 to wet completely the loaded laundry 30 is avoided.

In fact, the phase of introducing water W in the tub 3 (step 120) with the recirculation circuit 216 active (step 130) is carried out by slowly adding water W in the tub 3 from the inlet circuit 5 until a pre-fixed minimum level L1 of liquid is detected from the device 19.

If the liquid level L is below the minimum level L1 it means that the water introduced in the tub 3 is totally absorbed by the laundry 30 and more water is necessary to wet completely the laundry 30.

If the water level L reach the minimum level L1 it means that the laundry 30 is completely wetted and the introduction of water W in the tub 3 may be interrupted and hence the introducing phase (step 120) may be considered terminated.

After this phase (step 120) the water level L is substantially at the minimum level L1 which is below the bottom part 4*a* of the drum 4. The hollow space 12 between the tub 3 and the drum 4 is empty and free from any liquid, as shown in FIG. 6, and a minimum quantity of liquid is present on the first pipe 17 of the outlet circuit 15.

Figure 7:
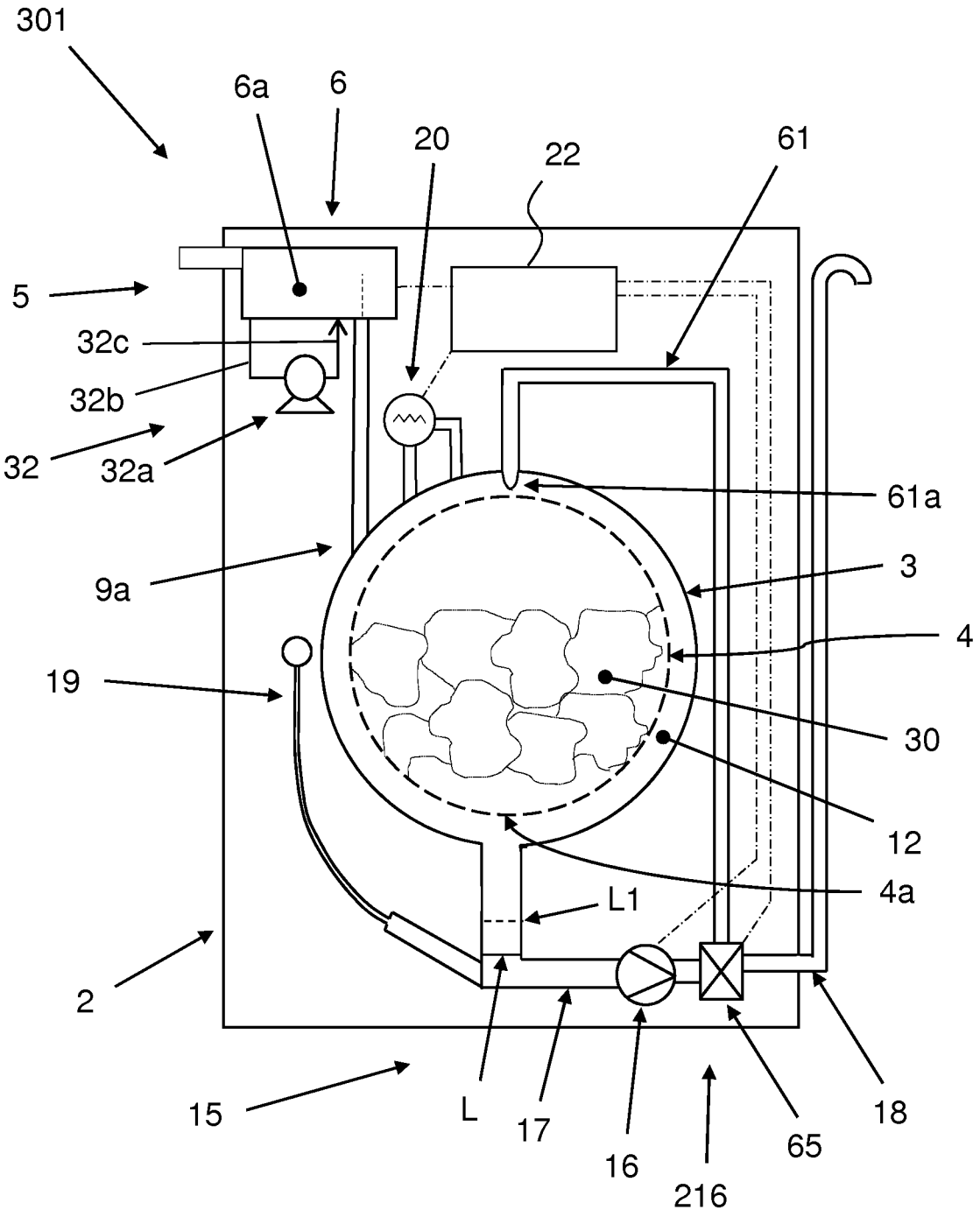
FIG. 7 shows a further embodiment in relation to FIG. 6.

FIG. 7 shows a construction variant washing machine 301 implementing a further embodiment of the method of the invention.

This washing machine 301 differs from the washing machine 201 shown in FIG. 6 for the fact that it comprises a mixing device 32 which is applied to the removable drawer 6.

The mixing device 32 is applied to a mixing compartment 6*a* of the removable drawer 6 and comprises a recirculation mixing pump 32*a*, an inlet connecting line 32*b* connecting the recirculation mixing pump 32*a* to the mixing compartment 6*a* and an outlet connecting line 32*c* connecting the recirculation mixing pump 32*a* to the mixing compartment 6*a*.

The recirculation mixing pump 32*a* is activated to recirculate the liquid inside the mixing compartment 6*a*. The recirculation mixing pump 32*a* withdraws liquid from the bottom of the mixing compartment 6*a* via the inlet connecting line 32*b* and discharges the liquid withdrawn back into the mixing compartment 6*a* via the outlet connecting line 32*c*.

Advantageously when the mixing compartment 6*a* contains detergent D and water W, the recirculation process allows the preparation of a more uniform washing solution S wherein the detergent D is properly dissolved or dispersed in the water W.

Figure 8:
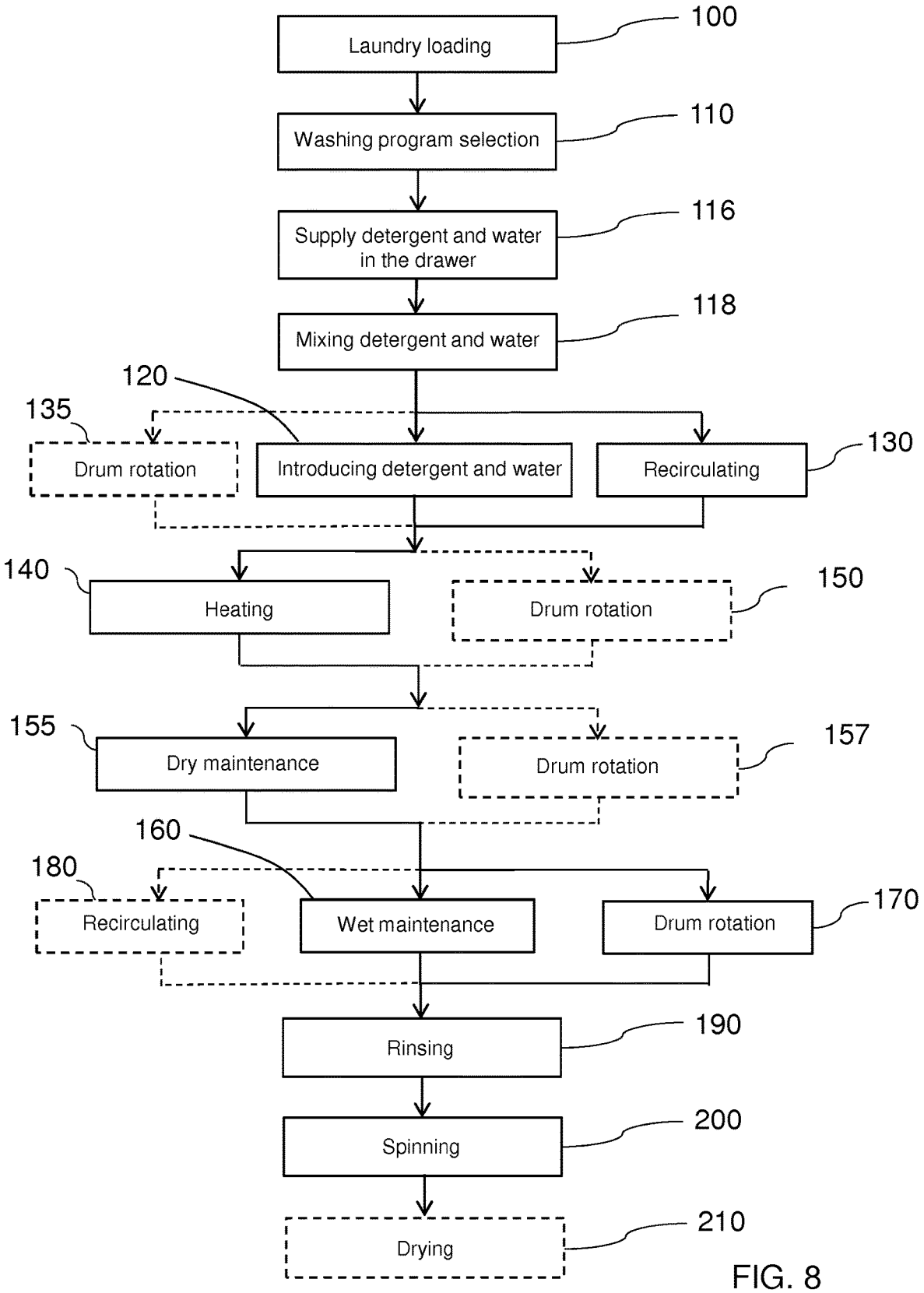
FIG. 8 is a simplified flow chart of the basic operations of a method for washing laundry in the washing machine of FIG. 7.

FIG. 8 shows the flow chart of the washing program of the invention performed in the washing machine 301 of FIG. 7.

The initial phases of the washing program of loading the laundry 30 (step 100) and of the washing program selection (step 110) are the same as described above.

In a successive phase (step 116) a quantity Qd of detergent D together with a first quantity $Q1_w$ of water W is introduced into the mixing compartment 6*a* of the drawer 6. The quantity Qd of detergent D and the first quantity $Q1_w$ of water W form the washing solution S intended to wet the laundry 30, as previously explained in the description.

After the introduction of the detergent D and of the water W in the mixing compartment 6*a*, the recirculation mixing pump 32*a* is activated to recirculate the liquid inside the mixing compartment 6*a* in order to prepare a uniform washing solution S (step 118).

The washing solution S is then introduced in the tub 3 (step 120) through the supply pipe 9 and the washing program may continue with the following phases as described above with reference to the flow chart of FIG. 3.

In further embodiments the washing solution S may be prepared in successive steps introducing successive quantities of detergent and/or successive quantities of water into the mixing compartment 6*a*. It is clear that at the end of the successive steps, the sum of the quantities of detergent introduced in the mixing compartment 6*a* corresponds to the quantity Qd and the sum of the quantities of water introduced in the mixing compartment 6*a* corresponds to the first quantity $Q1_w$.

Figure 9:
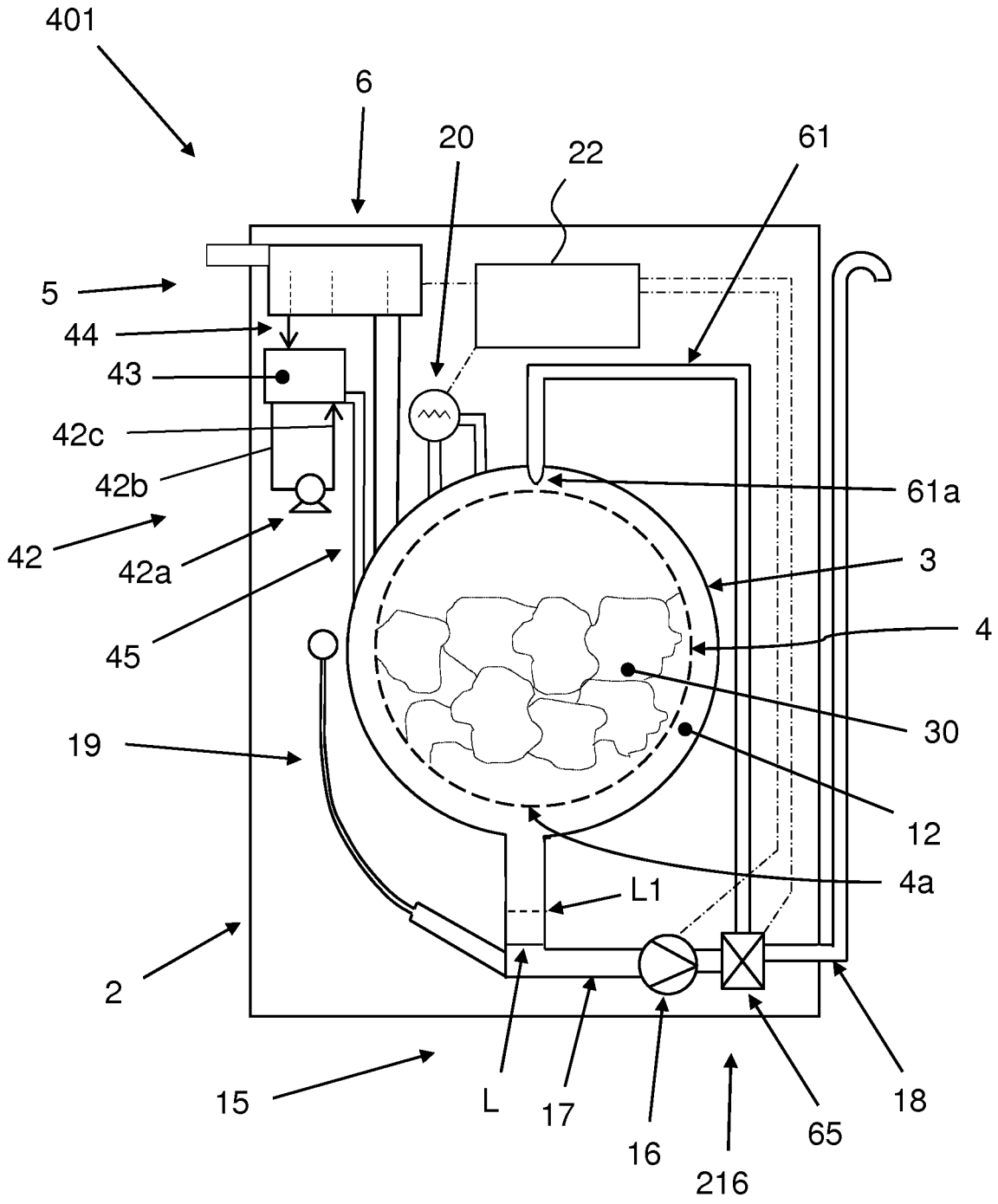
FIG. 9 shows a further embodiment in relation to FIG. 7.

FIG. 9 shows a construction variant washing machine 401 of the laundry washing machine of FIG. 7.

This washing machine 401, as the washing machine 301 shown in FIG. 7, allows the preparation of a properly mixed washing solution S before its introduction in the tub 3.

The washing machine 401 comprises a mixing device 42 which is associated to the removable drawer 6.

The mixing device 42 comprises a mixing tank 43 connected to the removable drawer 6 by an input supply pipe 44, a recirculation mixing pump 42*a*, an inlet connecting line 42*b* connecting the recirculation mixing pump 42*a* to the mixing tank 43, an outlet connecting line 42*c* connecting the recirculation mixing pump 42*a* to the mixing tank 43 and an output conveying pipe 45 connecting the mixing tank 43 to the tub 3.

The mixing tank 43 is supplied with a quantity Qd of detergent D and with a first quantity $Q1_w$ of water W by means of the supply pipe 44 which selectively withdraws detergent D and/or water W from the removable drawer 6.

The recirculation mixing pump 42*a* is activated to recirculate the liquid inside the mixing tank 43. The recirculation mixing pump 42*a* withdraws liquid from the bottom of the mixing tank 43 via the inlet connecting line 42*b* and discharges the liquid withdrawn back into the mixing tank 43 via the outlet connecting line 42*c*.

Advantageously the recirculation process allows the preparation of a uniform washing solution S wherein the detergent D is properly dissolved or dispersed in the water W.

The washing solution S is then introduced in the tub 3 through the output conveying pipe 45.

Figure 10:
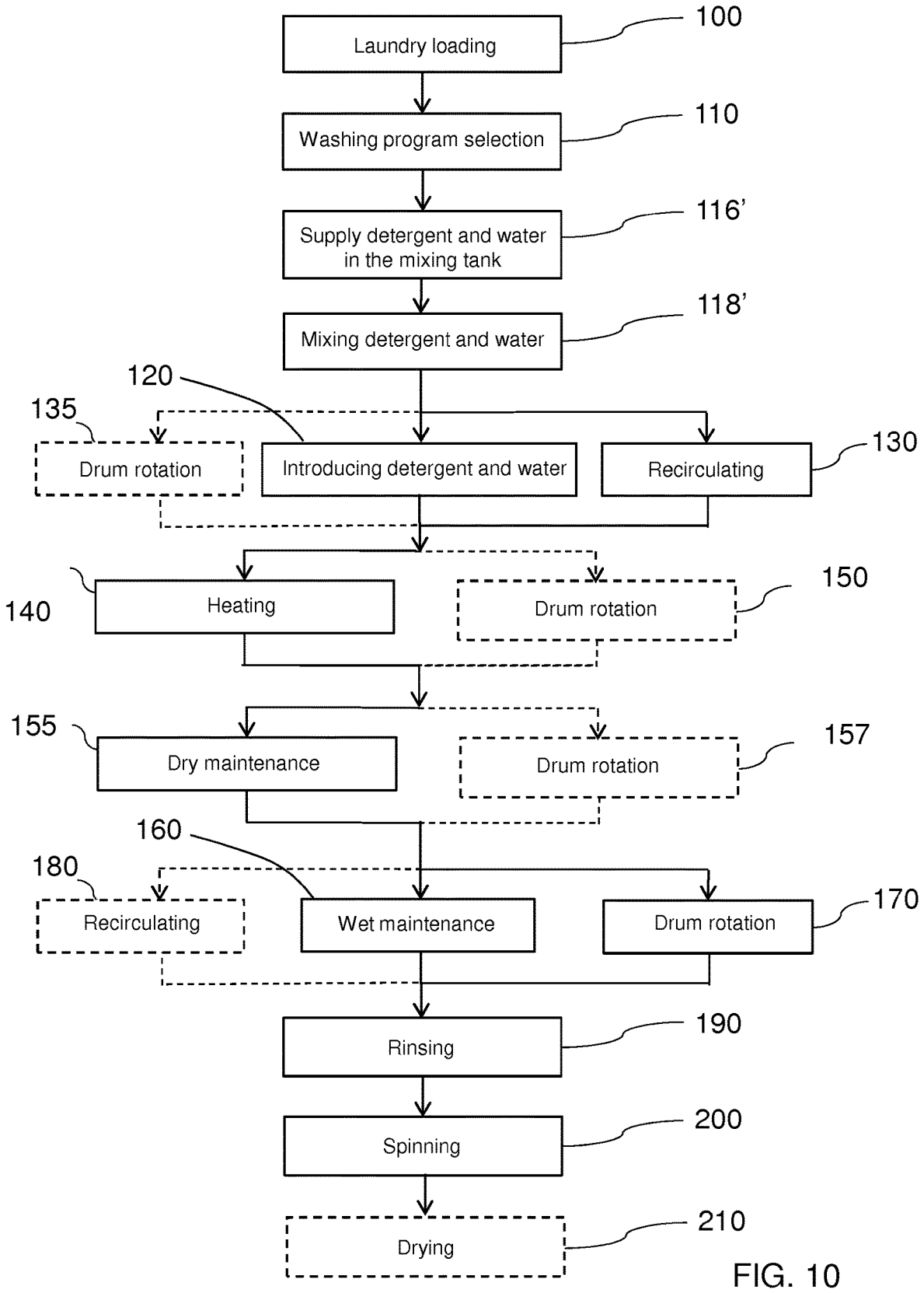
FIG. 10 is a simplified flow chart of the basic operations of a method for washing laundry in the washing machine of FIG. 9.

A washing program performed in this washing machine 401 is shown in FIG. 10 and differs from the washing program described with reference to the flow chart of FIG. 8 for the fact that the quantity Qd of detergent D together with the first quantity $Q1_w$ of water W is introduced into the mixing tank 43 (step 116'). The washing solution S is therefore prepared in the mixing tank 43 (step 118') by activating the recirculation mixing pump 42*a*. The washing solution S is then introduced in the tub 3 (step 120) through the output conveying pipe 45 and the washing program may continue with the following phases.

Figure 11:
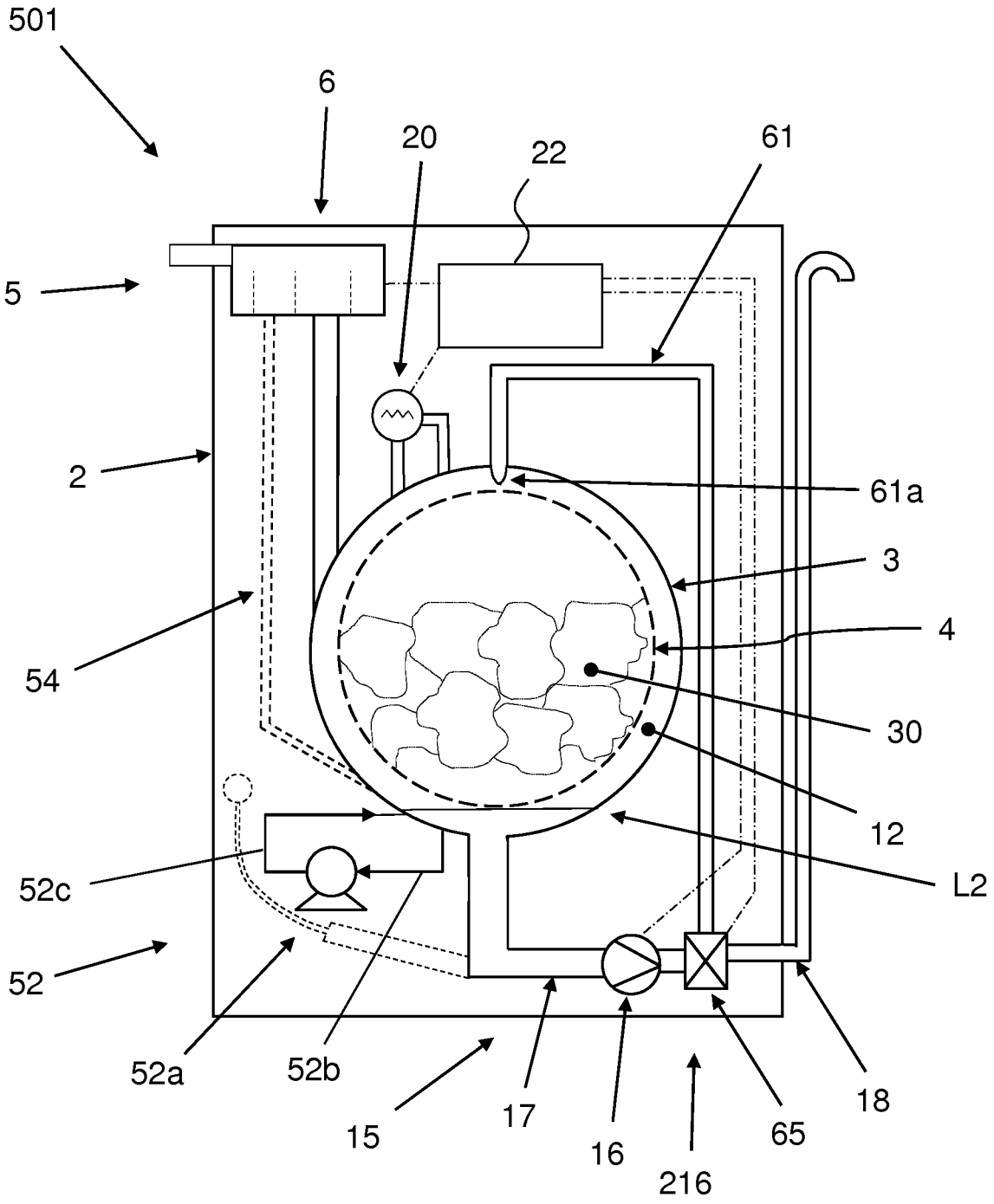
FIG. 11 shows a further embodiment in relation to FIG. 7.

FIG. 11 shows a construction variant washing machine 501 of the laundry washing machine of FIG. 7.

This washing machine 501, as the washing machine 301 shown in FIG. 7, allows the preparation of a properly mixed washing solution S.

The washing machine 501 comprises a mixing device 52 which is associated to bottom of the tub 3.

The mixing device 52 comprises a recirculation mixing pump 52*a*, an inlet connecting line 52*b* connecting the recirculation mixing pump 52*a* to the bottom of the tub 3 in a first zone thereof, an outlet connecting line 52*c* connecting the recirculation mixing pump 52*a* to the bottom of the tub 3 in a second zone thereof.

The recirculation mixing pump 52*a* is activated to recirculate the liquid inside the tub 3. The recirculation mixing pump 52*a* withdraws liquid from the bottom of the tub 3 via the inlet connecting line 52*b* and discharges the liquid withdrawn back into the bottom of the tub 3 via the outlet connecting line 52*c*.

Advantageously when the bottom of the tub 3 contains detergent D and water W, the recirculation process allows the preparation of a uniform washing solution S wherein the detergent D is properly dissolved or dispersed in the water W.

Figure 12:
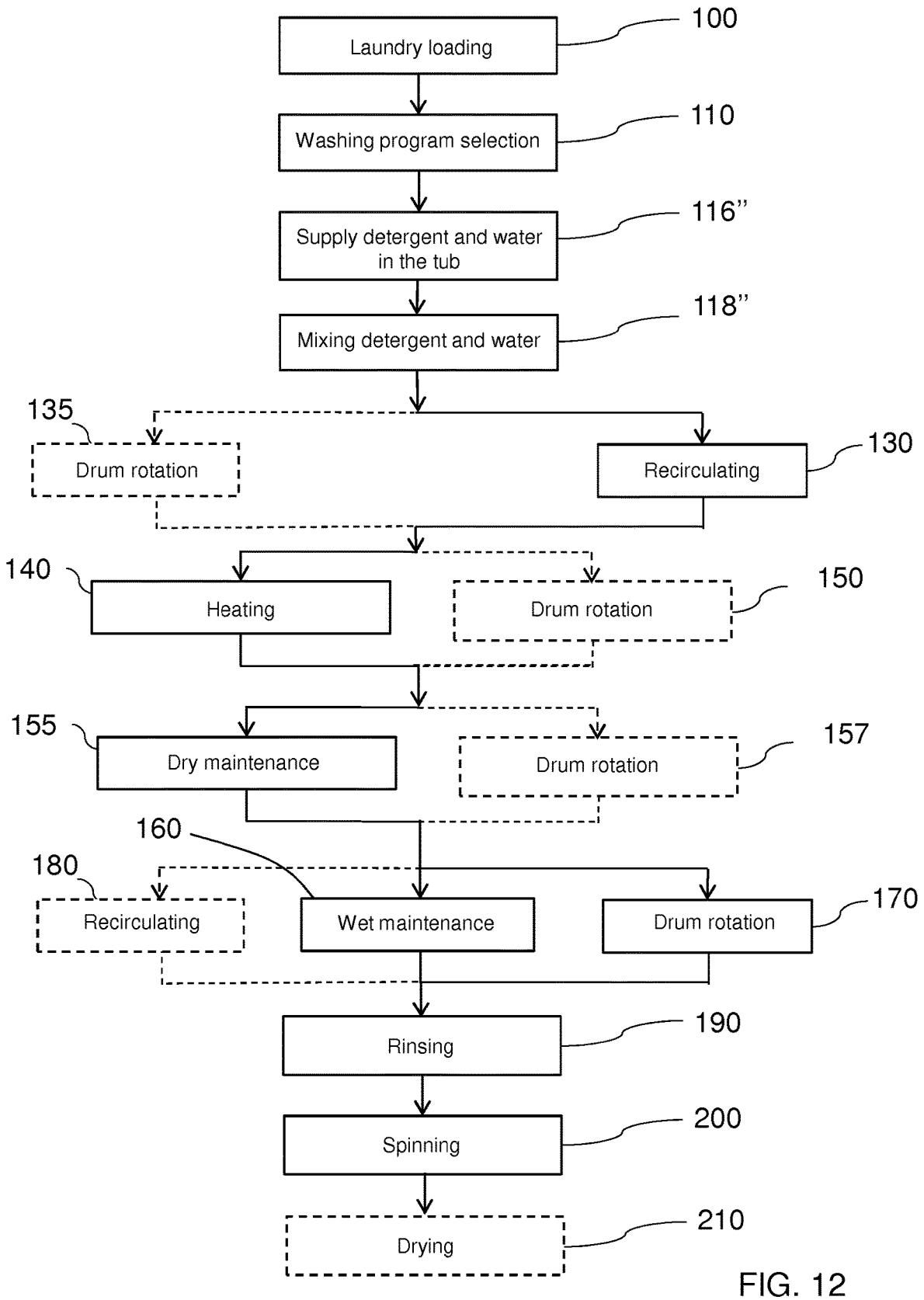
FIG. 12 is a simplified flow chart of the basic operations of a method for washing laundry in the washing machine of FIG. 11.

FIG. 12 shows the flow chart of the washing program of the invention performed in the washing machine 501 of FIG. 11.

The initial phases of the washing program of loading the laundry 30 (step 100) and of the washing program selection (step 110) are the same as described above.

In a successive phase (step 116") a quantity Qd of detergent D together with a first quantity $Q1_w$ of water W is introduced into the tub 3 from the drawer 6 by means of the supply pipe 9.

The quantity Qd of detergent D and the first quantity $Q1_w$ of water W forming the washing solution S fall down and reach a level L2 on the bottom of the tub 3.

The recirculation mixing pump 52*a* is then activated (step 118") to recirculate the liquid inside the tub 3 at the bottom thereof. The recirculation process allows to prepare a uniform washing solution S wherein the detergent D is properly dissolved or dispersed in the water W.

Once the washing solution S is ready and adequately mixed, the recirculation circuit 216 is activated (step 130) until the complete absorption of the washing solution S by the laundry 30. The washing program may then continue with the following phases.

In a further embodiment, the introduction phase of a quantity Qd of detergent D together with a first quantity $Q1_w$ of water W (step 116") is carried out by means of a supplemental supply pipe 54, indicated by a dashed line in the FIG. 11, which conveys the detergent D and the water W directly on the bottom of the tub 3.

While the mixing devices above described comprise a recirculation mixing circuit provided with a recirculation pump, it is obvious that different kinds of mixing devices may be used, like for example mixer devices provided with turbine blades which are immersed in the washing solution and here adequately moved to perform a uniform mixing.

In further embodiments, after the initial phase of placing the laundry inside the drum and the phase of selection of the desired washing program a phase of determining the dry weight $D_w$ of the loaded laundry may be performed.

The phase of determining the dry weight $D_w$ of the loaded laundry typically comprises a step of introducing a quantity of water inside the tub to wet the laundry together with one or more drum rotations at a pre-determined speed. The water is also preferably re-circulated. Hence the water from the bottom of the tub is drained to the outside. According to the measured quantity of water introduced into the tub, the measured quantity of water drained from the tub and the time necessary for its absorption by the laundry, it is possible to estimate the dry weight $D_w$ of the loaded laundry. This weight determining phase preferably terminates with a spinning step which is intended to extract the maximum quantity of water from the laundry, more preferably to extract almost all the water from the laundry. A quantity of residual water may nevertheless remain inside the laundry. After the weight determining phase the washing program may then proceed with the following phases as described before, namely introducing a quantity of detergent and water or introducing a pre-wetting quantity of water. It has to be noted that in this case the first quantity of water or the quantity of the pre-wetting water introduced in the tub will be adequately reduced of the quantity of the residual water remained inside the laundry in the previous weight determining phase. The quantity of the residual water inside the laundry may be easily calculated by the control unit through the measurement of the water conveyed in the tub and the water drained from the tub during the weight determining phase.

It has thus been shown that the present invention allows all the set objects to be achieved. In particular, it makes it possible to reduce the quantity of water required to wash the laundry and to reduced the power required to heat up the laundry inside and to obtain an optimum usage of the detergent and to reduce the quantity of detergent used compared to the known technique.

In particular, it makes it possible to obtain an optimum usage of the detergent and to reduce the quantity of detergent used compared to the known technique.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

It is underlined that the laundry washing machines illustrated in the enclosed figures, and with reference to which some embodiments of the method according to the invention have been described, are of the front-loading type; however it is clear that the method according to the invention can be applied as well to a top-loading washing machine, substantially without any modification.

The invention claimed is:

1. A method for washing laundry in a laundry washing machine comprising a washing tub external to a rotatable washing drum wherein the laundry to be washed is loaded, a recirculation circuit including a recirculation pump adapted to drain liquid from a bottom region of the washing tub and to re-admit the liquid into a higher region of the washing tub wherein the method comprising:

providing a quantity of detergent;

providing a first quantity of water to form with said quantity of detergent a quantity of washing solution;

introducing said washing solution into said washing tub;

recirculating said washing solution inside said washing tub by said recirculation circuit until said washing solution is absorbed by said loaded laundry inside said washing drum and the level of said washing solution is below said washing drum;

activating a heater for heating said wetted loaded laundry inside said washing drum;

deactivating said heater and maintaining said heated wetted loaded laundry inside said washing drum for a predetermined dry maintenance time;

supplying a second quantity of water in said washing tub;

rotating said washing drum; and rinsing said loaded laundry by drum rotations and by liquid drainage from said washing tub, wherein the method further comprises a mixing phase wherein said washing solution is mixed, the mixing phase takes place after the phase of introducing the washing solution into the washing tub and before the recirculating of said washing solution inside said washing tub by the recirculation circuit, wherein said mixing phase is carried out by a mixing device associated to the bottom of the washing tub, said mixing device comprises:

a mixing pump separate from the recirculation circuit, an inlet connecting line separate from the recirculation circuit, said inlet line connecting the mixing pump to the bottom of the washing tub in a first zone thereof, and a single outlet connecting line separate from the recirculation circuit, said single outlet connecting line connecting the mixing pump to the bottom of the tub in a second zone thereof, wherein the mixing pump is activated to mix the liquid inside the washing tub so that the mixing pump withdraws liquid from the bottom of the washing tub via the inlet connecting line and discharges the liquid withdrawn back into the bottom of the tub via the single outlet connecting line.

2. The method according to claim 1, further comprising a rotation phase of said washing drum during at least one of:

recirculating said washing solution inside said washing tub, heating said wetted loaded laundry inside said washing drum, and maintaining said heated wetted loaded laundry inside said washing drum for a predetermined dry maintenance time.

3. The method according to claim 2, further comprising carrying out a recirculating phase of liquid inside said washing tub after said phase of supplying a second quantity of water in said washing tub.

4. The method according to claim 2, further comprising carrying out a further phase of providing a pre-wetting quantity of water inside said washing tub in order to wet said loaded laundry before said phase of introducing said washing solution into said washing tub.

5. The method according to claim 2, wherein said heating phase comprises heating said loaded laundry with hot air.

6. The method according to claim 1, further comprising carrying out a recirculating phase of liquid inside said washing tub after said phase of supplying a second quantity of water in said washing tub.

7. The method according to claim 1, further comprising carrying out a further phase of providing a pre-wetting quantity of water inside said washing tub in order to wet said loaded laundry before said phase of introducing said washing solution into said washing tub.

8. The method according to claim 7, further comprising carrying out a recirculating phase of water inside said washing tub after said phase of providing a pre-wetting quantity of water.

9. The method according to claim 7, wherein said pre-wetting quantity of water is determined based on the quantity and/or on the type of said loaded laundry.

10. The method according to claim 7, wherein the ratio between the sum of the pre-wetting quantity of water and the first quantity of water and the dry weight of the loaded laundry is between 1 and 3 litres/kg.

11. The method according to claim 1, wherein said heating phase comprises heating said loaded laundry with hot air.

12. The method according to claim 1, wherein said heating phase comprises heating said loaded laundry with steam.

13. The method according to claim 1, wherein the ratio between said first quantity of water and the dry weight of the loaded laundry is between 1 and 3 litres/kg.

14. The method according to claim 1, wherein the ratio between said second quantity of water and the dry weight of the loaded laundry is comprised between 0.5 and 1.1 litres/kg.

* * * * *